United States Patent [19]

Sakaguchi et al.

[11] Patent Number: 4,555,476

[45] Date of Patent: Nov. 26, 1985

[54] HEAT DEVELOPMENT PROCESS WITH STABILIZER

[75] Inventors: Yukihiko Sakaguchi; Toshiaki Aono; Shinsaku Fujita, all of Kanagawa, Japan

[73] Assignee: Fuji Photo Film Co., Ltd., Kanagawa, Japan

[21] Appl. No.: 594,667

[22] Filed: Mar. 29, 1984

[30] Foreign Application Priority Data

Mar. 30, 1983 [JP] Japan ..... 58-54167

[51] Int. Cl.[4] ..... G03C 1/40; G03C 5/54

[52] U.S. Cl. ..... 430/351; 430/203; 430/219; 430/372; 430/607; 430/619

[58] Field of Search ..... 430/203, 219, 223, 351, 430/551, 372, 617, 619, 607

[56] References Cited

U.S. PATENT DOCUMENTS 2,356,486 8/1944 Weissberger et al. ..... 430/372

4,463,079 7/1984 Naito et al. ..... 430/203

*Primary Examiner*—Richard L. Schilling

*Attorney, Agent, or Firm*—Sughrue, Mion, Zinn, Macpeak & Seas

[57] ABSTRACT

An image-forming process is disclosed. This process comprises heating a photographic material comprising a support having provided thereon at least light-sensitive silver halide, binder, and a dye releasing redox compound in the presence of a compound represented by the following general formula (A):

wherein $R_1$ represents a (m+n)-valent straight, branched or cyclic alkane or a (m+n)-valent straight, branched or cyclic alkene, $R_2$ and $R_3$, which may be the same or different, each represents a straight, branched or cyclic alkyl group or a straight, branched or cyclic alkenyl group, n represents 0, 1, 2 or 3, and m represents 0, 1 or 2, with m+n being 1 or more, after, or simultaneously with, imagewise exposure in the state of substantial absence of water to thereby imagewise form a mobile dye.

7 Claims, No Drawings

HEAT DEVELOPMENT PROCESS WITH STABILIZER

FIELD OF THE INVENTION

This invention relates to a novel process for forming a dye image by heating in the state of substantial absence of water and, further, it relates to a novel photographic material containing a dye releasing redox compound capable of reacting, upon being heated in the state of substantial absence of water, with light-sensitive silver halide to release a hydrophilic dye.

More particularly, the present invention is concerned with a novel process for obtaining a dye image by transferring the heat-released dye to a dye-fixing layer.

BACKGROUND OF THE INVENTION

Heretofore, photographic process using silver halide has most widely been practiced, since it provides excellent photographic properties such as sensitivity, gradation, etc. as compared with, for example, electrophotographic process and diazo-type photographic process. In recent years, techniques have been developed which provide images easily in short time by employing, as photographic processing of forming images on photographic (high-sensitive) materials using silver halide, a dry processing involving heating in place of the conventional wet processing involving development in a developing solution.

Thermally developable photographic materials are known in the art, and thermally developable photographic materials and the process thereof are described in, for example, *Shashin Kogaku No Kiso,* pp. 553 and 555 (published by Corona Co., Ltd.), *Eizo Joho,* p. 40, April 1978, *Nebletts Handbook of Photography and Reprography,* 7th ed. (Van Nostrand Reinhold Company), pp. 32–33, U.S. Pat. Nos. 3,152,904, 3,301,678, 3,392,020 and 3,457,075, British Pat. Nos. 1,131,108, 1,167,777, and *Research Disclosure,* pp. 9–15, the June issue, 1978, (RD-17029).

Many processes have been proposed for obtaining color images in a dry manner. As to a process of forming color image by binding an oxidation product of a developing agent with a coupler, U.S. Pat. No. 3,531,286 proposes p-phenylenediamine type reducing agents and phenol or active methylene couplers, U.S. Pat. No. 3,761,270 proposes p-aminophenol type reducing agents, Belgian Pat. No. 802,519 and *Research Disclosure,* pp. 31 and 32 (September, 1975) propose sulfonamidophenol type reducing agents, and U.S. Pat. No. 4,021,240 proposes a combination of sulfonamidophenol type reducing agent and a 4-equivalent coupler.

However, these processes have the defect that, since an image of reduced silver and a color image are simultaneously formed in exposed portions after thermal development, the color image becomes turbid. As a means for removing this defect, the silver image is removed by a liquid treatment, or the dye alone is transferred to a sheet having another layer, for example, image-receiving sheet. However, it is not so easy to discriminate an unreacted compound from a dye and transfer only the dye.

*Research Disclosure,* pp. 54–58, the May issue, 1978, (RD-16966) describes a technique of introducing a nitrogen-containing hetero ring group into a dye to form a silver salt, and releasing the dye by thermal development. This technique fails to provide distinct image due to difficulty in depressing release of dye in unexposed portions, thus not being generally employed.

And, as to a process of forming positive color image according to heat-sensitive silver dye bleaching process, useful dyes and bleaching processes are described in, for example, *Research Disclosure,* pp. 30–32, the April issue, 1976, (RD-14433), ibid., pp. 14–15, the December issue, 1976, (RD-15227), and U.S. Pat. No. 4,235,957.

In these processes, however, an additional step and material are necessary for heating the materials with an activator sheet for accelerating a bleaching of dye superposed on them, and the resulting color images suffer gradual reductive bleaching during storage with the copresent free silver or the like.

U.S. Pat. Nos. 3,985,565 and 4,022,617 describe a process of forming color image by utilizing leuco dyes. However, with this process, stable incorporation of leuco dye in a photographic material is difficult, and the material is gradually colored during storage.

SUMMARY OF THE INVENTION

The present invention provides a novel process for forming dye image by heating in the state of substantial absence of water, which solves the problems with the conventional materials.

That is, an object of the present invention is to provide a novel image-forming process for obtaining dye image by transferring to a dye-fixing layer a movable, hydrophilic dye released through heating in the state of substantial absence of water.

Another object of the present invention is to provide a process for improving stability with time.

The term "stability with time" as used herein means stability of photographic material during storage before, for example, thermal development processing. That is, improvement of stability with time means to depress fog formation in photographic material during storage before thermal development processing and depress change in maximum density.

A further object of the present invention is to provide a simple process for obtaining distinct dye image.

These objects can be attained by an image-forming processes which comprises heating a photographic material comprising a support having provided thereon at least light-sensitive silver halide, binder, and a dye releasing redox compound which reduces light-sensitive silver halide and which releases a hydrophilic dye by a thermal reaction with light-sensitive silver halide in the presence of a compound represented by the following general formula (A):

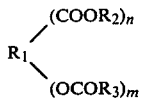

wherein $R_1$ represents a (m+n)-valent straight, branched or cyclic alkane or a (m+n)-valent straight, branched or cyclic alkene, $R_2$ and $R_3$, which may be the same or different, each represents a straight, branched or cyclic alkyl group or a straight, branched or cyclic alkenyl group, n represents 0, 1, 2 or 3, and m represents 0, 1 or 2, with total of m and n being 1 or more after, or simultaneously with, imagewise exposure in the state of substantial absence of water to imagewise form a mobile dye (movable dye).

The compound of general formula (A) is present in a layer of photographic materials or a layer of image-receiving materials.

DETAILED DESCRIPTION OF THE INVENTION

The alkane or alkene represented by $R_1$ in the general formula (A) may be substituted by a halogen atom (e.g., a chlorine atom, a bromine atom, etc.), an alkoxy group (e.g., a methoxy group, an ethoxy group, etc.), an alkyl group (e.g., a methyl group, an ethyl group, etc.), or the like, or may have an epoxy group. As the substituents, halogen atoms, alkoxy groups, alkyl groups, epoxy groups, etc. other than hydroxy groups are preferred.

The alkyl or alkenyl group represented by $R_2$ in the general formula (A) may be substituted by a halogen atom (e.g., a chlorine atom, a bromine atom, etc.), a hydroxy group, an alkyl group (e.g., a methyl group, an ethyl group, etc.), —OOCR′ (wherein R′ represents an alkyl or alkenyl group containing 1 to 20 carbon atoms), an alkoxy group (e.g., a methoxy group, an ethoxy group, etc.), or the like, or may have an epoxy group.

The alkyl or alkenyl group represented by $R_3$ in the general formula (A) may be substituted by a halogen atom (e.g., a chlorine atom, a bromine atom, etc.), an alkyl group (e.g., a methyl group, an ethyl group, etc.), —OOCR′ (wherein R′ represents an alkyl or alkenyl group containing 1 to 20 carbon attoms), an alkoxy group (e.g., a methoxy group, an ethoxy group, etc.), or the like, or may have an epoxy group.

The preferred examples of $R_1$ in the general formula (A) include alkanes containing 1 to 60 carbon atoms, preferably 1 to 40 carbon atoms, and alkenes containing 1 to 60 carbon atoms, preferably 1 to 40 carbon atoms. (The number of carbon atoms includes the number of carbon atoms contained in a substituent, if any.)

More preferable examples of $R_1$ are monovalent alkanes containing 1 to 40 carbon atoms such as a methyl group, an ethyl group, a propyl group, an isopropyl group, a butyl group, a sec-butyl group, an isobutyl group, a t-butyl group, a pentyl group, a hexyl group, a heptyl group, an octyl group, a nonyl group, a decyl group, an undecyl group, a dodecyl group, a tridecyl group, a pentadecyl group, a hexadecyl group, heptadecyl group, an octadecyl group, etc., which are generally represented by $C_kH_{2k+1}$— (k: an integer of 1 to 40).

Another preferable examples of $R_1$ are divalent alkanes containing 1 to 40 carbon atoms represented by the general formula of —$C_KH_{2k}$— (k: an integer of 1 to 40), such as —$CH_2$—, —$(CH_2)_2$—, —$(CH_2)_4$—, —$(CH_2)_7$—, —$(CH_2)_8$—, —$(CH_2)_{10}$—,

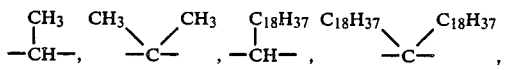

etc.

Further preferable examples of $R_1$ are monovalent alkanes containing 1 to 40 carbon atoms preferably represented by the general formula of $C_kH_{2k-1}$—(k: an integer of 1 to 40), such as $C_8H_{17}CH{=}CH(CH_2)_7$—.

Still further preferable examples of $R_1$ are divalent alkenes containing 1 to 40 carbon atoms preferably represented by the general formula of —$(C_kH_{2k-3})$— (k: an integer of 1 to 40), such as —CH=CH—,

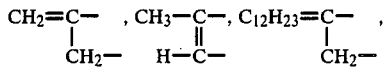

etc.

Still further preferable examples of $R_1$ are trivalent alkanes containing 1 to 40 carbon atoms represented by the general formula of —$(C_kH_{2k-1})$>, such as

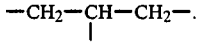

Still further preferable examples of $R_1$ are monovalent cyclic alkanes or alkenes containing 1 to 40 carbon atoms such as a cyclopentyl group, a cyclohexyl group, a cycloheptyl group, a cyclododecyl group, a cyclohexenyl group, an adamantyl group,

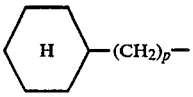

(p: an integer of 1 to 34), etc.

Still further preferable examples of $R_1$ are divalent cyclic alkanes or alkenes containing 1 to 40 carbon atoms such as

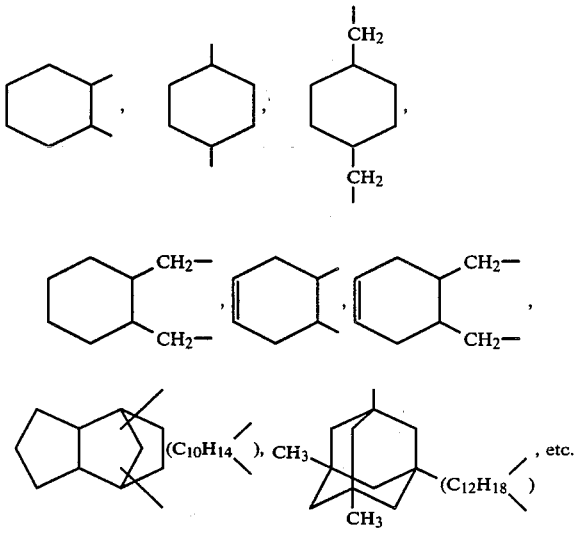

Alkanes illustrated above as examples of $R_1$ further substituted by an alkoxy group containing 1 to 40 carbon atoms, preferably 1 to 20 carbon atoms (e.g., a methoxy group, an ethoxy group, a butoxy group, a hexadecyloxy group, etc.), an acyl group containing 1 to 40 carbon atoms, preferably 1 to 20 carbon atoms (e.g., a fatty acid ester group containing 1 to 20 carbon atoms, an aromatic carboxylic acid ester group containing 1 to 20 carbon atoms, etc.), an epoxy group, a chlorine atom, a bromine atom or a fluorine atom are also illustrated as preferable examples of $R_1$.

As the examples of $R_2$ and $R_3$ in the general formula (A), alkyl groups containing 1 to 60 carbon atoms, preferably 1 to 40 carbon atoms, and alkenyl groups containing 1 to 60 carbon atoms, preferably 1 to 40 carbon atoms, are preferable. (The number of carbon atoms includes that of a substituent, if any.)

More preferable examples of $R_2$ are alkyl groups containing 1 to 40 carbon atoms such as a methyl group, an ethyl group, a propyl group, an isopropyl group, a butyl group, a sec-butyl group, an isobutyl group, a t-butyl group, a pentyl group, a hexyl group, a heptyl group, an octyl group, a nonyl group, a decyl group, an undecyl group, a dodecyl group, a tridecyl group, a pentadecyl group, a hexadecyl group, a heptadecyl group, an octadecyl group, etc., which are generally represented by $C_kH_{2k+1}$— (k: an integer of 1 to 40).

Another more preferable examples of $R_2$ are alkenyl groups containing 1 to 40 carbon atoms represented preferably by $C_kH_{2k-1}$— (k: an integer of 1 to 40), such as $C_8H_{17}CH{=}CH(CH_2)_8$—, $CH_2{=}CH{-}(CH_2)_8$—, etc.

Further more preferable examples of $R_2$ are monovalent cyclic alkyl or alkenyl groups containing 1 to 40 carbon atoms preferably represented by $C_kH_{2k-l}$ (wherein k represents an integer of 1 to 40, and l represents an integer of 3, 5 or 7), such as a cyclopentyl group, a cyclohexyl group, a cycloheptyl group, a cyclododecyl group, a cyclohexenyl group, adamantyl group, etc.

Alkyl groups illustrated above as examples of $R_2$ and further substituted by an alkoxy group containing 1 to 40 carbon atoms, preferably 1 to 20 carbon atoms (e.g., a methoxy group, an ethoxy group, a butoxy group, a hexadecyloxy group, etc.), an acyloxy group containing 1 to 20 carbon atoms (e.g., a fatty acid ester group containing 1 to 20 carbon atoms, an aromatic acid ester containing 1 to 20 carbon atoms, etc.), an epoxy group, a hydroxy group, a chlorine atom or a fluorine atom are also preferable examples of $R_2$.

More preferable examples of $R_3$ are alkyl groups containing 1 to 40 carbon atoms such as methyl group, an ethyl group, a propyl group, an isopropyl group, a butyl group, a sec-butyl group, an isobutyl group, a t-butyl group, a pentyl group, a hexyl group, a heptyl group, an octyl group, a nonyl group, a decyl group, an undecyl group, a dodecyl group, a tridecyl group, a pentadecyl group, a hexadecyl group, a heptadecyl group, an oxtadecyl group, etc., which are generally represented by $C_kH_{2k+1}$— (wherein k represents an integer of 1 to 40).

Another more preferable examples of $R_3$ are alkenyl groups containing 1 to 40 carbon atoms preferably represented by $C_kH_{2k-1}$— (wherein k represents an integer of 1 to 40), such as $C_8H_{17}CH{=}CH(CH_2)_7$—.

Further more preferable examples of $R_3$ are monovalent cyclic alkyl or alkenyl groups containing 1 to 40 carbon atoms preferably represented by $C_kH_{2k-l}$— (wherein k represents an integer of 1 to 40, and l represents an integer of 3, 5 or 7), such as a cylopentyl group, a cyclohexyl group, a cycloheptyl group, a cyclododecyl group, a cyclohexenyl group, an adamantyl group, etc.

Alkyl groups illustrated above as examples of $R_3$ and further substituted by an alkoxy group containing 1 to 40 carbon atoms, preferably 1 to 20 carbon atoms (e.g., a methoxy group, an ethoxy group, a butoxy group, a hexadecyloxy group, etc.), an acyloxy group containing 1 to 40 carbon atoms, preferably 1 to 20 carbon atoms (e.g., a fatty acid ester group containing 1 to 20 carbon atoms, an aromatic carboxylic acid ester group containing 1 to 20 carbon atoms, etc.), an epoxy group, a chlorine atom, or a fluorine atom are also preferable examples of $R_3$.

As $R_1$ in the general formula (A), straight, branched or cyclic alkyl groups (including cycloalkyl groups such as adamantane are preferable and, as $R_2$ or $R_3$, straight or branched alkyl groups are preferable.

As the compounds represented by the general formula (A), those compounds wherein m represents 0, n represents 1, $R_1$ represents a straight or branched alkyl group or an adamantyl group, and $R_2$ and $R_3$ each represents a straight or branched alkyl group, those compounds wherein m represents 1, n represents 3, and $R_1$ to $R_3$ each represents a straight or branched alkyl group or its residue, and those compounds wherein m represents 0, n represents 2, $R_1$ represents a cycloalkyl residue, and $R_2$ and $R_3$ each represents a straight or branched alkyl group are preferable.

Specific examples of the compounds represented by the general formula (A) are illustrated below which, however, are not to be construed as limiting the compounds of the present invention in any way.

$CH_3COOCH_2CH_2OCH_3$ (1)

(2)

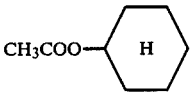

$C_{13}H_{27}COOCH_2CH(C_6H_{13})C_8H_{17}$ (3)

$C_{13}H_{27}COOC_{18}H_{37}$—iso (4)

$C_{15}H_{31}COOC_{18}H_{35}$ (5)

$C_{17}H_{33}COOCH_3$ (6)

$C_{17}H_{35}COOCH_3$ (7)

$C_{17}H_{35}COOC_{16}H_{33}$ (8)

(9)

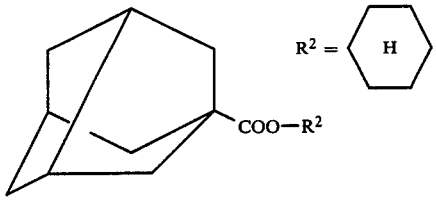

$R^2$ =

(10)

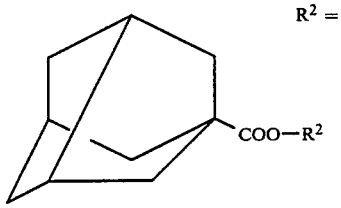

$R^2 = CH_2{-}CH(C_2H_5)C_4H_7$ (11)

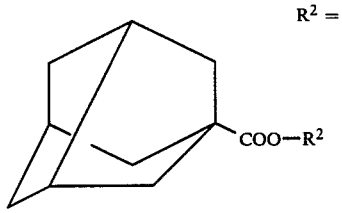

$R^2 = C_{18}H_{37}$—iso $C_8H_{17}CH{-}CH(CH_2)_7COOC_4H_9$ (12)

$C_8H_{17}CH{-}CH(CH_2)_7COOC_8H_{17}$ (13)

-continued
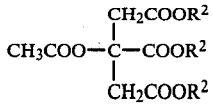
$R^2 = C_2H_5$ (14)
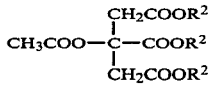
$R^2 = C_4H_9$ (15)
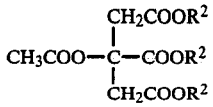
$R^2 = C_6H_{13}$ (16)
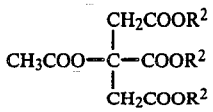
$R^2 = CH_2—CH—C_4H_9$ (17)
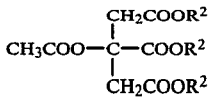
$R^2 = C_{12}H_{23}$ (18)
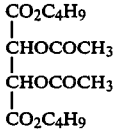
(19)
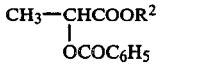
$R^2 = C_2H_5$ (20)
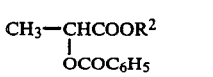
$R^2 = C_3H_7$ (21)
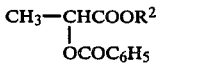
$R^2 = C_4H_9$ (22)
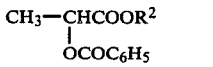
$R^2 = C_5H_{11}$ (23)
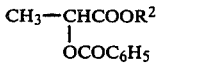
$R^2 = C_6H_{13}$ (24)
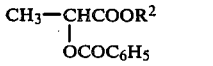
$R^2 = CH_2—CH(C_2H_5)—C_4H_9$ (25)
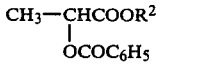
$R^2 = C_{12}H_{23}$ (26)
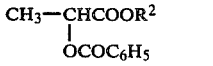
$R^2 = C_{18}H_{37}$—iso (27)
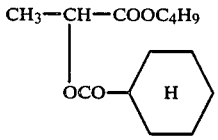
(28)
-continued
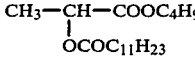
(29)
(30)
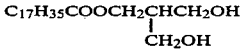
(31)
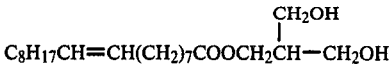
(32)
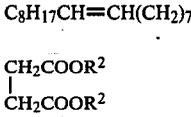
$R^2 = C_4H_9$ (33)
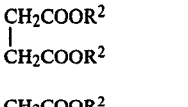
$R^2 = C_{12}H_{25}$ (34)
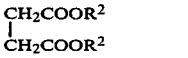
$R^2 = —CH_2—CH(C_2H_5)—C_4H_9$ (35)
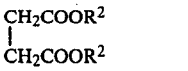
$R^2 = C_{10}H_{21}$—iso (36)
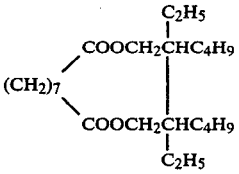
(37)
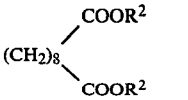
$R^2 = C_4H_9$ (38)
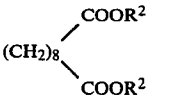
$R^2 = CH_2CH(C_2H_5)C_4H_9$ (39)
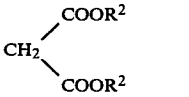
$R^2 = C_9H_{19}$—iso (40)
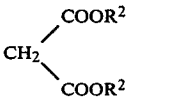
$R^2 = C_{10}H_{21}$ (41)
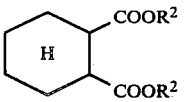
$R^2 = C_4H_9$ (42)
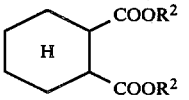
$R^2 = —CH_2—CH(C_2H_5)—C_4H_9$ (43)
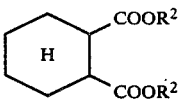
$R^2 = C_{12}H_{25}$ (44)

-continued
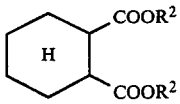
$R^2 = C_{16}H_{33}$ (45)
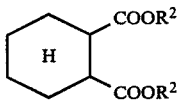
$R^2 = C_{18}H_{35}$ (46)
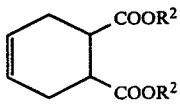
$R^2 = C_{12}H_{25}$ (47)
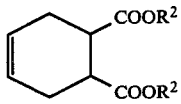
$R^2 = C_{14}H_{29}$ (48)
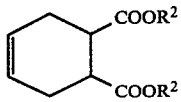
$R^2 = C_{16}H_{33}$ (49)
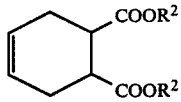
$R^2 = C_{18}H_{37}$ (50)
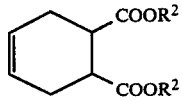
$R^2 = \text{iso-}C_{10}H_{21}$ (51)
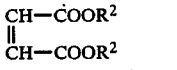
$R^2 =$ 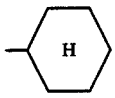 (52)
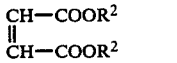
$R^2 = CH_2CH(C_2H_5)C_4H_9$ (53)
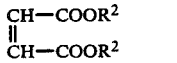
$R^2 = C_9H_{19}$—iso (54)
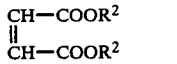
$R^2 =$ 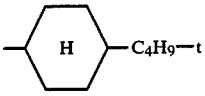 (55)
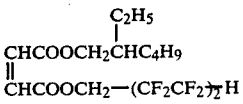
(56)
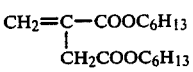
(57)
-continued
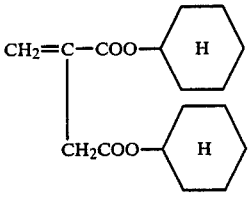
(58)
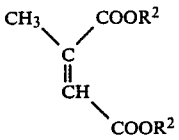
$(R^2 = C_{16}H_{33-n})$ (59)
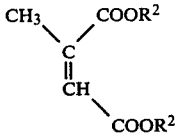
$R^2 = CH_2CH(C_2H_5)C_4H_9$ (60)
$C_{11}H_{23}COOCH_2(CF_2—CF_2)_3—H$ (61)
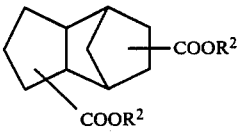
$R^2 = CH_3$ (62)
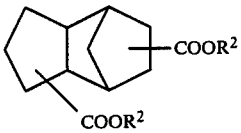
$R^2 = —CH_2—CH(C_2H_5)—C_4H_9$ (63)
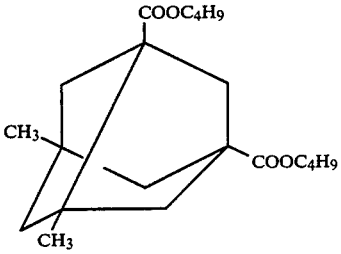
(64)
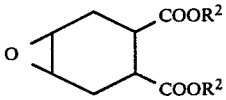
$R^2 = C_8H_{17}$ (65)
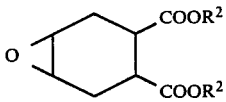
$R^2 = C_{10}H_{21}$—iso (66)
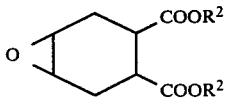
$R^2 = C_{18}H_{37}$ (67)
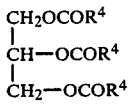
$R^4 = CH_3$ (68)

-continued

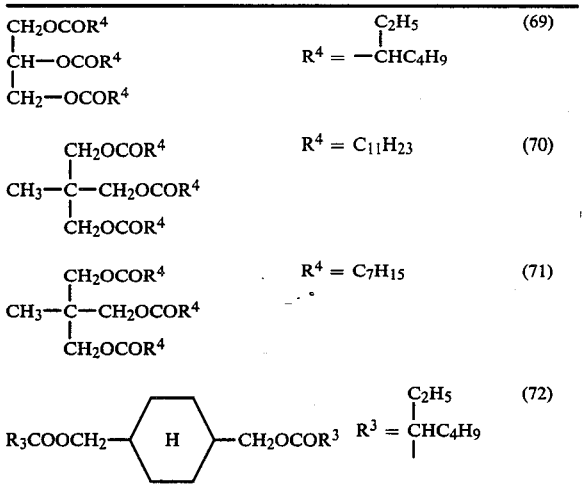

In addition, fatty acid esters described in *Yushi Kagaku Binran* revised 2nd. ed. (Maruzen, 1971), pp. 91 to 101, Tables 2.9, 2.10, 2.11, 2.12, 2.13, 2.14, 2.16, 2.7, 2.18, etc. are also effective in the present invention.

Further, dibasic acid esters, etc. described in the same book, pp. 104–107, Tables 2.26, 2.27, 2.28, 2.29, and 2.30 are also effective in the present invention.

Still further, esters described in the same book, pp. 108–125, Tables 2.32, 2.64, 2.62, 2.66, 2.70, 2.71, and 2.72 are also effective in the present invention.

The compounds of the general formula (A) are obtained by heating a carboxylic acid, $R_1$+COOH)$_m$ or $R_3COOH$, and an alcohol, $R_2OH$ or $R_1(OH)_2$ (esterification reaction) ($R_1$, $R_2$, $R_3$ and m are same as in general formula (A)). This esterification proceeds in the absence of catalyst by heating to higher temperatures (230° to 270° C.), but is usually conducted at low temperatures by using an acid catalyst such as hydrogen chloride, sulfuric acid or p-toluenesulfonic acid. In this esterification, liquid acids and alcohols do not require solvents, but such solvents as benzene and toluene may be used. As to other synthesizing processes, see *Yushi Kagaku Binran,* revised 2nd. ed. (Maruzen, 1971), pp. 536–543, and references cited there. Also, descriptions of S. R. Sandler & W. Karo, *Organic Functional Group Reactions* pp. 245–268, (Adademic Press, 1968), and descriptions of the references cited there are instructive.

As a synthesis example, synthesis of amyl acetate is described below.

Synthesis Example 30 g of glacial acetic acid, 35 g of 1-pentanol, 60 ml of benzene, and 0.2 g of p-toluenesulfonic acid were mixed and refluxed under heating for two hours, during which produced water was removed by azeotropy with benzene. The reaction mixture was washed with, successively, a sodium bicarbonate aqueous solution, water, and a saturated sodium chloride aqueous solution, then distilled. Yield: 40 g; b.p. 140°–146° C.

Many of the above-illustrated compounds can be synthesized in the same manner. As to commercially available compounds such as butyl stearate, glyceryl monostearate, diethylene glycol diacetate, diethylene glycol monlaurate, diethylene glycol dipelargonate, triethylene glycol dipelargonate, butyl cellosolve pelargonate, di-n-butyl adipate, diisobutyl adipate, di-(2-ethylhexyl)adipate, diisooctyl adipate, diisodecyl adipate, octyldecyl adipate, dicapryl adipate, benzyl-n-butyl adipate, di-(2-ethylhexyl)azelate, diisooctyl azelate, di-n-hexyl azelate, diisopropyl azelate, dimethyl sebacate, diethyl sebacate, dibutyl sebacate, di-(2-ethylhexyl)sebacate, diisooctyl sebacate, di-n-butyl maleate, dimethyl maleate, di-(2-ethylhexyl)maleate, dinonyl maleate, dibutyl fumarate, di-(2-ethylhexyl)fumarate, methyl oleate, butyl oleate, methoxyethyl oleate, etc., commercially available products were used. Lists of these commercially available compounds are described in, for example, "Handbook of Rubber.Plastic-Compounding Chemicals", pp. 126–140. (Rubber Digest, 1966).

The compounds of the present invention are used as follows. One of them or a mixture of two or more of them is dispersed in a hydrophilic colloid aqueous solution using a dispersing assistant. This dispersing method is described in, for example, U.S. Pat. Nos. 2,304,939, 2,322,027, 2,801,170, 2,801,171, 2,949,360, etc.

In this occasion, the compounds of the present invention may be used in combination with such high-boiling organic solvents as alkyl phthalates (e.g., dibutyl phthalate, dioctyl phthalate, etc.), phosphoric esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octyl benzoate, etc.), alkylamides (e.g., diethyllaurylamide, etc.), and the like.

Usually, the compound of the present invention is dispersed in a hydrophilic colloid aqueous solution together with a dye releasing redox compound and a low-boiling organic solvent having a boiling point of about 30° C. to about 160° C. using a dispersing assistant. If necessary, other photographic additives may be simultaneously dispersed.

As the low-boiling organic solvent having a boiling point of 30° to 160° C., lower alkyl acetates such as ethyl acetate and butyl acetate, ethyl propionate, sec-butyl alcohol, methyl isobutyl ketone, β-ethoxyethyl acetate, methyl cellosolve acetate, cyclohexanone, etc. are used.

As the dispersing assistant, anionic surfactants (e.g., sodium alkylbenzensulfonate, sodium dioctylsulfosuccinate, sodium dodecylsulfate, sodium alkylnaphthalenesulfonate, Fisher type couplers, etc.), amphoteric surfactants (e.g., N-tetradecyl-N,N-dipolyethylene-α-betaine, etc.), and nonionic surfactants (e.g., sorbitan monolaurate, etc.) are usually used. Further, surfactants described in other parts of this specification can similarly be used as the dispersing assistants.

The dispersion comprising the compound of the present invention containing the dye releasing redox compound can be added to one or both of emulsion layers such as silver halide emulsion layers and interlayers of thermally developable light-sensitive materials. Further, the dispersion comprising the compound of the present invention not containing the dye-providing substance can be used in hydrophilic colloidal layers (e.g., surface-protecting layer, interlayer, etc.) and emulsion layers (e.g., silver halide emulsion layers) of thermally developable light-sensitive materials, layers containing a mordant of fixing material to be described hereinafter, and other layers. In introducing the compound of the present invention into a layer of a light-sensitive material, known methods described in, for example, U.S. Pat. No. 2,322,027 can be employed.

The compound of the present invention is used usually in an amount (by weight) 0.01 to 20 times, preferably 0.01 to 5 times, as much as that of the dye releasing redox compound.

Where the compound of the present invention does not contain the dye releasing redox compound, i.e., the case that compound of the general formula A is contained in an image-receiving material (the image-receiving layer is applied on the another support base provided separately from that having a photographic layer applied thereon), the compound of the present invention is used preferably in an amount of 0.001 to 5 g/m$^2$.

The dye image of the present invention includes multi-color and mono-color dye images, with the latter including mono-color dye image of two or more mixed dyes.

According to the image-forming process of the present invention, a silver image and a movable dye image in conformity with the silver image can be simultaneously obtained by merely heating after imagewise exposure. That is, in the image-forming process of the present invention, when the thermally developable color photographic material is imagewise exposed and thermally developed in the state of substantial absence of water, an oxidation-reduction takes place between light-sensitive silver halide and reductive dye releasing redox compound in the presence of exposed silver halide which functions as a catalyst to produce a silver image in exposed portions. In this step, the dye releasing redox compound is oxidized with silver halide to form an oxidation product and, as a result, a hydrophilic movable dye is released, thus a silver image and a movable dye being obtained in exposed portions. In this occasion, presence of a dye-releasing activators accelerates the above-described reaction. A dye image can be obtained by transferring the movable dye to, for example, a dye-fixing layer. These are with the case of using negative emulsions. Where autopositive emulsions are used, the same results are obtained except that a silver image and a movable dye are formed in unexposed portions.

The oxidation-reduction reaction of the present invention between light-sensitive silver halide and dye releasing redox compound and the subsequent dye-releasing reaction are characterized in that they proceed at elevated temperatures in the dye state of substantial absence of water. The term "elevated temperatures" means temperatures of 80° C. or above; and the term "the dry state of substantial absence of water" means the state in equilibrium with moisture in the air and not supplied with water from the outside of the system. Such state is described in *The Theory of the photographic process,* 4th. ed. (edited by T. H. James, Macmillan), p. 374. The fact that the reaction conversion (reaction ratio) does not decrease with samples having been vacuum dried under $10^{-3}$ mmHg shows that a sufficient conversion can be attained even in the dry state of substantial absence of water.

The dye-releasing reaction has conventionally been believed to be caused by the attack of a so-called nucleophilic reagent, and is usually conducted in a liquid having a pH as high as 10 or above. Thus, it is unexpected result that a high conversion is attained at elevated temperatures in the dry state of substantial absence of water as in the present invention. The dye releasing redox compound of the present invention can undergo oxidation-reduction reaction with silver halide without the help of a so-called auxiliary developing agent. This is a result unexpectable from the conventional knowledge on wet-process development at ordinary temperatures.

The above-described reactions particularly well proceed in the presence of an organic silver salt oxidizing agent to show high image density. Therefore, copresence of the organic silver salt oxidizing agent is a particularly preferable embodiment.

The dye releasing redox compound which releases a hydrophilic dye used in the present invention is a compound described in European Patent Publication (unexamined) No. 76,492 as a dye releasing compound and is represented by the following general formula:

$$R_a—SO_2—D$$

wherein $R_a$ represents a reducing group capable of being oxidized by the silver halide; and D represents an image forming dye portion containing a hydrophilic group.

The above-described compound is oxidized corresponding to or reversely corresponding to latent image distributed imagewise in the silver halide and releases imagewise a mobile dye.

The detail definitions of $R_a$ and D, examples of the specific compounds and synthesis examples thereof are described in European Patent Publication (unexamined) No. 76,492.

As the dye releasing redox compounds used in the present invention, the compounds as described, for example, in U.S. Pat. No. 4,055,428, Japanese Patent Publication (unexamined) Nos. 12642/81, 16130/81, 16131/81, 650/82 and 4043/82, U.S. Pat. Nos. 2,928,312 and 4,076,529, U.S. Published Patent Application B No. 351,673, U.S. Pat. Nos. 4,135,929 and 4,198,235, Japanese Patent Publication (unexamined) No. 46730/78, U.S. Pat. Nos. 4,273,855, 4,149,892, 4,142,891 and 4,258,120, etc., are also effective in addition to the above-described compounds.

Further, the dye releasing redox compounds which release a yellow dye as described, for example, in U.S. Pat. Nos. 4,013,633, 4,156,609, 4,148,641, 4,165,987, 4,148,643, 4,183,755, 4,246,414, 4,268,025 and 4,245,023, Japanese Patent Publication (unexamined) Nos. 70172/81, 25737/81, 138744/80, 134849/80, 106727/77, 114930/76, etc., can be effectively used in the present invention.

The dye releasing redox compounds which release a magenta dye as described, for example, in U.S. Pat. Nos. 3,954,476, 3,932,380, 3,931,144, 3,932,381, 4,268,624 and 4,255,509, Japanese Patent Publication (unexamined) Nos. 73057/81, 71060/81, 134850/80, 40402/80, 36804/80, 23628/78, 106727/77, 33142/80 and 53329/80, etc., can be effectively used in the present invention.

The dye releasing redox compounds which release a cyan dye as described, for example, in U.S. Pat. Nos. 3,929,760, 4,013,635, 3,942,987, 4,273,708, 4,148,642, 4,183,754, 4,147,544, 4,165,238, 4,246,414 and 4,268,625, Japanese Patent Publication (unexamined) Nos. 71061/81, 47823/78, 8827/77 and 143323/78, etc., can be effectively used in the present invention.

Two or more of the dye releasing redox compounds can be used together. In these cases, two or more dye releasing redox compounds may be used together in order to represent the same color or in order to represent black color.

The dye releasing redox compounds are suitably used in a range from 10 mg/m$^2$ to 15 g/m$^2$ and preferably in a range from 20 mg/m$^2$ to 10 mg/m$^2$ in a total.

In the present invention, if necessary, a reducing agent may be used. The reducing agent in this case is the so-called auxiliary developing agent, which is oxidized by the silver halide and/or the organic silver salt oxidizing agent to form its oxidized product having an ability to oxidize the reducing group $R_a$ in the dye releasing redox compound.

Examples of useful auxiliary developing agents include the compounds specifically described in European Patent Publication (unexamined) No. 76492.

The silver halide used in the present invention includes silver chloride, silver chlorobromide, silver chloroiodide, silver bromide, silver iodobromide, silver chloroiodobromide and silver iodide, etc.

In the embodiment of the present invention in which the organic silver salt oxidizing agent is not used together with but the silver halide is used alone, particularly preferred silver halide is silver halide partially containing a silver iodide crystal in its grain. That is, the silver halide which shows the X-ray diffraction pattern of pure silver iodide is particularly preferred.

In photographic materials a silver halide containing two or more kinds of halogen atoms can be used. Such a silver halide is present in the form of a completely mixed crystal in a conventional silver halide emulsion. For example, the grain of silver iodobromide shows X-ray diffraction pattern at a position corresponding to the mixed ratio of silver iodide crystal and silver bromide crystal but not at a position corresponding to pure silver iodide crystal and pure silver bromide crystal separately.

Particularly preferred examples of silver halide used in the present invention include silver chloroiodide, silver iodobromide, and silver chloroiodobromide each containing silver iodide crystal in its grain and showing X-ray diffraction pattern of silver iodide crystal.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., of a combination thereof. The details thereof are described in T. H. James, *The Theory of the Photographic Process,* the Fourth Edition, Chapter 5, pages 149 to 169.

In the particularly preferred embodiment of the present invention, an organic silver salt oxidizing agent is used together. The organic silver salt oxidizing agent is a silver salt which forms a silver image by reacting with the above-described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the photographic material which provides higher color density can be obtained.

The silver halide used in this case is not always necessarily to have the characteristic in that the silver halide contains pure silver iodide crystal in the case of using the silver halide alone. Any silver halide which is known in the art can be used.

Examples of such organic silver salt oxidizing agents include those described in European Patent Publication (unexamined) No. 76,492.

A silver salt of an organic compound having a carboxy group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Publication (unexamined) Nos. 32928/75, 42529/76, 13224/74 and 17216/75, and U.S. Pat. No. 3,700,458.

A suitable coating amount of the light-sensitive silver halide and the organic silver salt oxidizing agent employed in the present invention is in a total of from 50 mg/m$^2$ to 10 g/m$^2$ calculated as an amount of silver.

The light-sensitive silver halide and the organic silver salt oxidizing agent used in the present invention are prepared in the binder as described below. Further, the dye releasing redox compound is dispersed in the binder described below.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, etc., a cellulose derivative, a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonal dyes. Of these dyes, cyanine dyes, merocyanine dyes and complex merocyanine dyes are particularly useful. Any conventionally utilized nucleus for cyanine dyes, such as basic heterocyclic nuclei, can be contained in these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

As nuclei having a ketomethylene structure, 5- or 6-membered heterocyclic nuclei such as pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be used in merocyanine dyes and complex merocyanine dyes.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat Nos. 1,344,281 and 1,507,803, Japanese Patent Publication Nos. 4936/68 and 12375/78, Japanese Patent Publication (unexamined) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a super-sensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. Nos. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the photographic material or used as the dye fixing material, if desired, according to the present invention is that which can endure at the processing temperature. As an ordinary support, not only glass, paper, metal or analogues thereto may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer sch as polyethylene, etc., can be used. The polyesters described in U.S. Pat. Nos. 3,634,089 and 3,725,070 are preferably used.

It is advantageous to use a compound represented by the general formula described below in the heat-developable color photographic material in order to accelerate development and accelerate release of a dye.

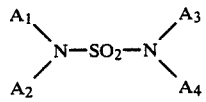

(A)

wherein $A_1$, $A_2$, $A_3$ and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_1$ and $A_2$ or $A_3$ and $A_4$ may combine with each other to form a ring.

The above-described compound can be used in an amount of broad range. A useful range is up to 20% by weight based on the amount of a dry layer coated of the photographic material. A range of 0.1% by weight to 15% by weight is more preferred.

It is advantageous to use a water releasing compound in the present invention in order to accelerate the dye releasing reaction.

The water releasing compound means a compound which releases water by decomposition during heat development. These compounds are particularly known in the field of printing of fabrics, and $NH_4Fe(SO_4)_2.12H_2O$, etc., as described in Japanese Patent Publication (unexamined) No. 88386/75 are useful.

Further, in the present invention, it is possible to use a compound which activates development and stabilizes the image at the same time. Particularly, it is preferred to use isothiuroniums including 2-hydroxyethylisothiuronium trichloroacetate as described in U.S. Pat. No. 3,301,678, bisisothiuroniums including 1,8 -(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)-methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

In the present invention, it is possible to use a thermal solvent. The term "thermal solvent" means a non-hydrolyzable organic material which melts at a temperature of heat treatment and meets at a lower temperature of heat treatment when it is present together with other components. Preferred examples of thermal solvents include compounds which can act as a solvent for the developing agent and compounds having a high dielectric constant which accelerate physical development of silver salts. Examples of preferred thermal solvents include those described in European Patent Publication (unexamined) No. 76,492.

In the present invention, though it is not always necessary to further incorporate substances or dyes for preventing irradiation or halation in the photographic material, because the photographic material is colored by the dye releasing redox compound, it is possible to add filter dyes or light absorbing materials, etc. into the photographic material, as described in Japanese Patent Publication No. 3692/73 and U.S. Pat. Nos. 3,253,921, 2,527,583 and 2,956,879, etc., in order to further improve sharpness. It is preferred that these dyes have a thermal bleaching property. For example, dyes as described in U.S. Pat. Nos. 3,769,019, 3,745,009 and 3,615,432 are preferred.

The photographic material used in the present invention may contain, if necessary, various additives known for the heat-developable photographic materials and may have a layer other than the light-sensitive layer, for example, an antistatic layer, an electrically conductive layer, a protective layer, an intermediate layer, an antihalation layer, a strippable layer, etc.

The photographic emulsion layer and other hydrophilic colloid layers in the photographic material of the present invention may contain various surface active agents for various purposes, for example, as coating aids or for prevention of electrically charging, improvement of lubricating property, emulsification, prevention of adhesion, improvement of photographic properties (for example, acceleration of development, rendering hard tone or sensitization), etc.

For example, it is possible to use nonionic surface active agents such as saponin (steroid saponin), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, polyethylene oxide adducts of silicone, etc.), glycidal derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonate, alkylbenzene sulfonate, alkylnaphthalenesulfonate, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a recurring unit of ethylene oxide in their molecules may be preferably incorporated into the photographic. material. It is particularly preferred that the molecule contains 5 or more of the recurring units of ethylene oxide.

The nonionic surface active agents capable of satisfying the above-described conditions are well known as to their structures, properties and methods of synthesis. These nonionic surface active agents are widely used even outside this field. Representative references relating to these agents include: *Surfactant Science Series,* Vol. 1, Nonionic Surfactants (edited by Martin J. Schick, Marcel Dekker Inc., 1967), and *Surface Active Ethylene Oxide Adducts* (edited by Schoufeldt N. Pergamon Press, 1969). Among the nonionic surface active agents described in the above-mentioned references, those capable of satisfying the above-described conditions are preferably employed in connection with the present invention.

The nonionic surface active agents can be used individually or as a mixture of two or more of them.

The polyethylene glycol type nonionic surface active agents can be used in an amount of less than 100% by weight, preferably less than 50% by weight, based on a hydrophilic binder.

The photographic material of the present invention may contain a cationic compound containing a pyridinium salt. Examples of the cationic compounds containing a pyridinium group used are described in PSA Journal Section B 36 (1953), U.S. Pat. Nos. 2,648,604 and 3,671,247, Japanese Patent Publication Nos. 30074/69 and 9503/69, etc.

In the photographic material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

Examples of various additives include those described in *Research Disclosure,* Vol. 170, No. 17029 (June, 1978), for example, plasticizers, dyes for improving sharpness, antihalation dyes, sensitizing dyes, matting agents, fluorescent whitening agents and fading preventing agents, etc.

If necessary, two or more layers may be coated at the same time by the method as described in U.S. Pat. No. 2,761,791 and British Pat. No. 837,095.

Various means for exposure can be used in the present invention. Latent images are obtained by imagewise exposure by radiant rays including visible rays. Generally, light sources of this invention include tungsten lamps, mercury lamps, halogen lamps such as iodine lamps, xenon lamps, laser light sources, CRT light sources, fluorescent tubes and light-emitting diodes, etc.

In the present invention, after the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above-described temperature range. Particularly, a temperature range of about 110° C. to about 160° C. is useful.

As the heating means, a simple heat plate, iron, heat roller, heat generator utilizing carbon or titanium white, etc., or analogues thereto may be used.

In the present invention, a specific method for forming a color image by heat development comprises transfer of a hydrophilic mobile dye. For this purpose, the heat-developable color photographic material of the present invention is composed of a support having thereon a light-sensitive layer (I) containing at least silver halide, if necessary, an organic silver salt oxidizing agent, a dye releasing redox compound which is also a reducing agent for the organic silver salt oxidizing agent and a binder, and a dye fixing layer (II) capable of receiving the hydrophilic dye formed in the photographic layer (I).

The above described photographic layer (I) and the dye fixing layer (II) may be formed on the same support, or they may be formed on different supports, respectively. The dye fixing layer (II) can be stripped off the photographic layer (I). For example, after the heat-developable color photographic material is exposed imagewise to light, it is developed by heating uniformly and thereafter the dye fixing layer (II) or the photographic layer (I) is peeled apart. Also, when a photographic material having the photographic layer coated on a support and a fixing material having the dye fixing layer (II) coated on a support are separately formed, after the photographic material is exposed imagewise to light and uniformly heated, the mobile dye can be transferred on the dye fixing layer (II) by superposing the fixing material on the photographic layer.

Further, there is a method wherein only the photographic layer (I) is exposed imagewise to light and heated uniformly by superposing the dye fixing layer (II) on the photographic layer (I).

The dye fixing layer (II) can contain, for example, a dye mordant in order to fix the dye. In the present invention, various mordants can be used, and polymer mordants are particularly preferred. In addition to the mordants, the dye fixing layer may contain the bases, base precursors and thermal solvents. In particular, it is particularly preferred to incorporate the bases or base precursors into the dye fixing layer (II) in the cases wherein the photographic layer (I) and the dye fixing layer are formed on different supports.

Preferred polymer mordants used in the present invention can be polymers containing secondary and tertiary amino groups, polymers containing nitrogen-containing heterocyclic moieties, polymers having quaternary cation groups thereof, having a molecular weight of from 5,000 to 200,000, and particularly from 10,000 to 50,000.

For example, there are illustrated vinylpyridine polymers and vinylpyridinium cation polymers as disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096 and 4,128,538, British Pat. No. 1,277,453, etc., aqueous sol type mordants as disclosed in U.S. Pat. Nos. 3,958,995, 2,721,852 and 2,798,063, Japanese Patent Publication (unexamined) Nos. 115228/79, 145529/79 and 126027/79, etc., water-insoluble mordants as disclosed in U.S. Pat. No. 3,989,088, etc., reactive mordants capable of forming covalent bonds with dyes used as disclosed in U.S. Pat. No. 4,168,976 (Japanese Patent Publication (unexamined) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Publication (unexamined) Nos. 71332/75, 30328/78, 155528/77, 125/78 and 1024/78, etc.

In addition, mordants disclosed in U.S. Pat. Nos. 2,675,316 and 2,882,156 can be used.

The dye fixing layer (II) can have a white reflective layer. For example, a lyer of titanium dioxide dispersed in gelatin can be provided on the mordant layer on a transparent support. The layer of titanium dioxide forms a white opaque layer, by which reflection color images of the transferred color images which can be observed through the transparent support is obtained.

Typical dye fixing material used in the present invention is obtained by mixing the polymer containing ammonium salt groups with gelatin and applying the mixture to a transparent support.

The transfer of dyes from the photographic layer to the dye fixing layer can be carried out using a dye transfer assistant. Examples of useful dye transfer assistant include water and an alkaline aqueous solution containing sodium hydroxide, potassium hydroxide and an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant can be employed by wetting the image receiving layer with the transfer assistant or by incorporating it in the form of water of crystallization or microcapsules into the material.

The present invention will now be described in greater detail by reference to the following examples and comparative examples which are given here for illustrative purposes only and are by no means intended to limit the scope of the invention.

EXAMPLE 1

A process for preparing a silver bromoiodide emulsion is first described.

40 g of gelatin and 26 g of potassium bromide (KBr) were dissolved in 3,000 ml of water. The resulting solution was stirred at 50° C. Then, a solution of 34 g of silver nitrate dissolved in 200 ml of water was added to the above-described solution in 10 minutes.

Thereafter, a solution of 3.3 g of potassium iodide (KI) in 100 ml of water was added thereto in 2 minutes.

PH of the thus prepared silver bromoiodide emulsion was adjusted to cause sedimentation, then excess salts were removed.

The pH of the emulsion was then adjusted to 6.0 to obtain 400 g of a silver bromoiodide emulsion.

Then, a process for preparing a gelatin dispersion of the dye releasing redox compound containing the compound of the present invention is described below.

5 g of dye releasing redox compound (A) described below,

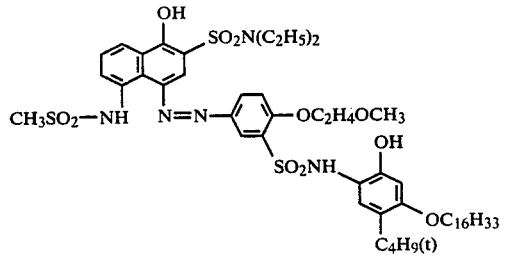

0.5 g of sodium 2-ethylhexyl sulfosuccinate (as a surfactant), and 5 g of compound (3) of the present invention were weighed, and 30 ml of ethylacetate was added thereto, followed by heating to about 60° C. to dissolve.

Thus, a uniform solution was obtained. This solution was mixed with 100 g of a 10% solution of lime-processed gelatin under stirring, then the mixture was subjected to dispersing in a homogenizer for ten minutes at 10,000 rpm. The resulting dispersion was referred to as a dispersion of dye releasing redox compound containing compound of the present invention.

A process for preparing a photographic material is described below.

(a) Light-sensitive silver bromoiodide emulsion: 25 g
(b) Dispersion of dye releasing redox compound containing the compound of the present invention: 33 g
(c) 10 wt% Ethanol solution of guanidine trichloroacetic acid: 15 ml
(d) 5 wt% Aqueous solution of the compound having the following structure:

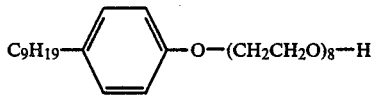

(e) 10% Aqueous solution of dimethylsulfamide 4 ml
(f) Water 5 ml (a) to (f) described above were mixed and dissolved, then coated on a polyethylene terephthalate film in a wet thickness of 30 μm. A 3% aqueous solution of gelatin was coated thereon in a wet thickness of 30 μm to form a protective layer. This sample was referred to as sample (A).

As a comparative sample, samples (B) and (B') were prepared in the same manner as with sample (A) except for using comparative compounds (1) and (2), respectively, in place of the compound (3) of the present invention in the dispersion of the dye releasing redox compound containing the compound of the present invention.

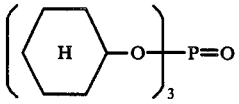

comparative compound (1)

$C_{11}H_{23}CON(CH_3)_2$ comparative compound (2)

Each of these samples was dried, imagewise exposed for ten seconds at 2,000 1× using a tungsten electric bulb, and uniformly heated for 30 seconds on a heat block heated to 130° C.

Process for preparing a dye-fixing material is described below.

10 g of poly(methyl acrylate-co-N,N,N-trimethyl-N-vinylbenzylammonium chloride) (ratio of methyl acrylate to vinylbenzylammonium chloride=1:1) was dissolved in 200 ml of water, and uniformly mixed with 100 g of 10% lime-processed gelatin. The resulting mixture was uniformly coated on a paper support laminated with polyethylene containing dispersed therein titanium dioxide in a wet thickness of 90 μm.

After drying, this sample was used as a dye-fixing material having a mordant layer.

After dipping this dye-fixing material in water, each of the above-described heated photographic materials was superposed thereon with the coated surfaces facing to each other. Then, the assembly was heated for 6 seconds on a 80° C. heat block. When the dye-fixing material was delaminated from the photographic material, a negative magenta color image was formed on the dye-fixing material. Maximum density (Dmax) and fog density (Dmin) of the negative material for green light were measured using a Macbeth reflection densitometer (RD-519).

Separately, samples (A), (B), and (B') were stored for 3 months at room temperature with light being interrupted, and subjected to exposure, heating, and transfer steps under the same conditions as with the samples not having been stored. Densities of the resulting negative image for green light were measured using a Macbeth reflection densitometer (RD-519).

Results thus obtained are shown in Table 1.

TABLE 1

| | Immediately after Coating & Drying | | After Storage for 3 Months | |
|---|---|---|---|---|
| Sample | $D_{max}$ | $D_{min}$ | $D_{max}$ | $D_{min}$ |
| (A) | 1.72 | 0.16 | 1.85 | 0.49 |
| (B) | 2.05 | 0.26 | 2.38 | 2.10 |
| (B') | 2.32 | 0.31 | 2.39 | 2.35 |

Table 1 shows that formation of fog and change in maximum density are depressed by the compound of the present invention, thus stability with time being improved.

EXAMPLE 2

An example using benzotriazole silver salt, an organic silver salt oxidizing agent, is described below.

A benzotriazole silver salt emulsion was prepared as follows.

28 g of gelatin and 13.2 g of benzotriazole were dissolved in 3,000 ml of water. This solution was stirred at 40° C. To this solution was added a solution of 17 g of silver nitrate in 100 ml of water in 2 minutes.

The pH of this benzotriazole silver salt emulsion was adjusted to flocculate (sedimentation), and excess salts were removed. Then, the pH was adjusted to 6.0 to obtain 400 g of a benzotriazole silver salt emulsion.

The following photographic material was prepared using this benzotriazole silver salt emulsion.

(a) Silver bromoiodide emulsion used in Example 1: 22 g
(b) Benzotriazole silver salt emulsion: 6 g
(c) Dispersion (prepared in the same manner as in Example 1 except for using a compound given in Table 2 in place of compound (3) of the present invention): 33 g
(d) 10 wt% Ethanol solution of quanidine trichloroacetic acid: 16 ml
(e) 5 wt% Aqueous solution of the compound of the following structure: 5 ml

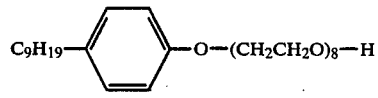

(f) 10 wt% Aqueous solution of dimethylsulfamide: 4 ml
(g) Water: 5 ml (a) to (g) described above were mixed and dissolved, then coated on a polyethylene terephthalate film in a wet thickness of 30 μm. A 3% gelatin aqueous solution was coated thereon in a wet thickness of 30 μm to form a protective layer.

Samples (C) to (H) were prepared in the same manner as with the above-described photographic material except for using, respectively, dispersions of dye-releasing redox compound (B) described below.

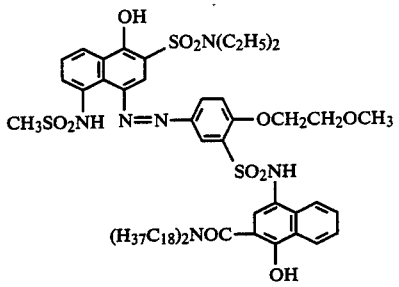

Sample (I) was prepared by using comparative compound (1) in place of the compound of the present invention.

TABLE 2

| Sample | Compound of the Present Invention | Dye-Releasing Redox Compound |
|---|---|---|
| (C) | (45) | (B) |
| (D) | (14) | (B) |
| (E) | (10) | (B) |
| (F) | (12) | (B) |
| (G) | (48) | (B) |
| (H) | (18) | (B) |
| (I) | Comparative Compound (1) | (B) |

Immediately after coating and drying or 2 days after storing thermostatic chamber at 50° C., each of samples (C) to (I) was subjected to image-wise exposure, heating, and transfer steps, and reflection density for green light was measured in the same manner as in Example 1. Results thus obtained are shown in Table 3.

TABLE 3

| Sample | Immediately After Coating and Drying | | After Storing 2 Days at 50° C. | |
|---|---|---|---|---|
| | $D_{max}$ | $D_{min}$ | $D_{max}$ | $D_{min}$ |
| (C) | 1.60 | 0.25 | 1.92 | 0.44 |
| (D) | 1.98 | 0.33 | 2.11 | 0.61 |
| (E) | 1.52 | 0.42 | 1.87 | 0.69 |
| (F) | 1.81 | 0.34 | 1.99 | 0.78 |
| (G) | 1.20 | 0.21 | 1.55 | 0.39 |
| (H) | 1.34 | 0.19 | 1.96 | 0.98 |
| (I) | 2.32 | 0.28 | 2.47 | 2.29 |

Table 3 shows that the use of the compound of the present invention serves to depress fog formation during storage and improve stability with time.

EXAMPLE 3

Samples (J) to (O) were prepared in the same manner as with sample (D) in Example 2 except for using dye releasing redox compounds shown in Table 4. In samples (K), (M), and (O), comparative compound (1) was used in place of the compound of the present invention.

TABLE 4

| Sample | Compound of the Present Invention | Dye-Releasing Redox Compound | (Hue) |
|---|---|---|---|
| (J) | (14) | (C) | (yellow) |
| (K) | Comparative compound (1) | (C) | (yellow) |
| (L) | (14) | (D) | (magenta) |

TABLE 4-continued

| Sample | Compound of the Present Invention | Dye-Releasing Redox Compound | (Hue) |
|---|---|---|---|
| (M) | Comparative compound (1) | (D) | (magenta) |
| (N) | (14) | (E) | (cyan) |
| (O) | Comparative compound (1) | (E) | (cyan) |

Note:
In the above Table 4, the dye-releasing redox compounds (C), (D) and (E) are as follows.

(C)

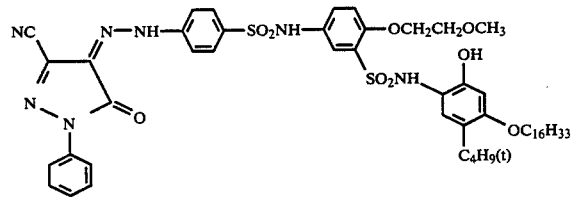

(D)

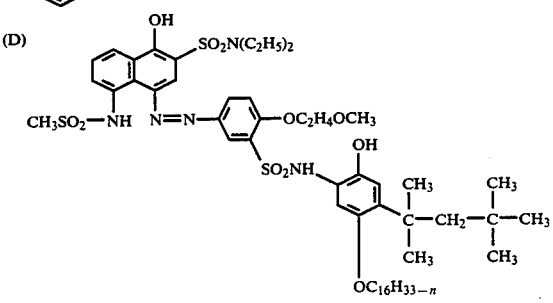

(E)

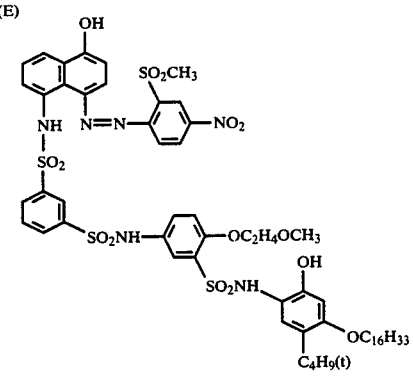

Each of samples (J) to (O) was subjected to the steps of imagewise exposure, heating, and transfer immediately after coating and drying or two days after storing in a thermostatic chamber at 50° C., and reflection density for blue light (samples (J) and (K)), green light (samples (L) and (M)), or red light (samples (N) and (O)) was measured in the same manner as in Example 1. Results thus obtained are shown in Table 5.

TABLE 5

| Sample | Immediately After Coating and Drying | | After Storing 2 Days at 50° C. | |
|---|---|---|---|---|
| | $D_{max}$ | $D_{min}$ | $D_{max}$ | $D_{min}$ |
| (J) | 1.42 | 0.18 | 1.67 | 0.33 |
| (K) | 1.95 | 0.17 | 2.20 | 1.02 |
| (L) | 1.79 | 0.24 | 1.96 | 0.49 |
| (M) | 2.00 | 0.28 | 2.32 | 2.05 |
| (N) | 1.28 | 0.16 | 1.52 | 0.31 |
| (O) | 1.89 | 0.17 | 2.16 | 0.97 |

It is seen from Table 5 that, with dye-providing substances (C), (D), and (E), too, the use of the compound of the present invention serves to depress fog formation during storage and thus improve stability with time.

EXAMPLE 4

Samples (P), (Q) and (R) were prepared in the same manner as in Example 2 except for using a compound (5), (26) and (46) of the present invention and dye releasing redox compound (A) given in Table 6 in place of the compounds of the present invention and the dye releasing redox compound B used in Example 2.

TABLE 6

| Sample No. | Compound of the Invention | Dye-Releasing Redox Compound |
|---|---|---|
| (P) | (5) | (A) (same as Example 1) |
| (Q) | (26) | (A) (same as Example 1) |
| (R) | (46) | (A) (same as Example 1) |

Immediately after coating and drying or two days after storing in a 50° C. thermostatic chamber, each of samples (P) to (R) was subjected to the steps of imagewise exposure, heating and transfer. With every sample, fogging with time was depressed.

While the invention has been described in detail and with reference to specific embodiments thereof, it will be apparent to one skilled in the art that various changes and modifications can be made therein without departing from the spirit and scope thereof.

What is claimed is:

1. An image-forming process, which comprises heating a photographic material comprising a support having provided thereon at least light-sensitive silver halide, binder, and a dye releasing redox compound in the presence of a compound represented by the following general formula (A):

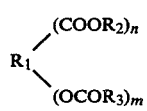

wherein $R_1$ represents a (m+n)-valent straight, branched or cyclic alkane or a (m+n)-valent straight, branched or cyclic alkene, $R_2$ and $R_3$, which may be the same or different, each represents a straight, branched or cyclic alkyl group or a straight, branched or cyclic alkenyl group, n represents 0, 1, 2 or 3, and m represents 0, 1 or 2, with m+n being 1 or more, after, or simultaneously with, imagewise exposure in the state of substantial absence of water to thereby imagewise form a mobile dye, wherein said thermally developable photographic material comprises said support having thereon one or more layers containing said light-sensitive silver halide which is a high-sensitive silver halide, said dye releasing redox compound, said binder, an organic silver salt and compound of general formula (A), said compound of general formula (A) improving stability of said thermally developable photographic material during storage before thermal development processing and depressing changes in maximum density, wherein the alkane or alkene represented by $R_1$ is substituted by a halogen atom, an alkoxy group, or an alkyl group, or has an epoxy group; the alkyl or alkenyl group represented by $R_2$ is substituted by a halogen atom, a hydroxy group, an alkyl group, —OOCR′, wherein R′ represents an alkyl or alkenyl group containing 1 to 20 carbon atoms, an alkoxy group, or has an epoxy group; and the alkyl or alkenyl group represented by $R_3$ is substituted by a halogen atom, an alkyl group, —OOCR′, wherein R′ represents an alkyl or alkenyl group containing 1 to 20 carbon atoms, an alkoxy group or has an epoxy group.

2. An image-forming process according to claim 1, wherein the organic silver salt oxidizing agent coexists in the dye-releasing reaction.

3. An image-forming process according to claim 1, wherein the alkane or alkene represented by $R_1$ contains 1 to 60 carbon atoms.

4. An image-forming process according to claim 3, wherein the alkane or alkene represented by $R_1$ contains 1 to 40 carbon atoms.

5. An image-forming process according to claim 1, wherein the alkyl or alkenyl group represented by $R_2$ and $R_3$ contains 1 to 60 carbon atoms.

6. An image-forming process according to claim 5, wherein the alkyl or alkenyl group represented by $R_2$ and $R_3$ contains 1 to 40 carbon atoms.

7. A thermally developable photographic material comprising a support having thereon one or more layers containing a high-sensitive silver halide, a dye releasing redox compound, the organic silver salt and the compound of general formula (A) of claim 1.

* * * * *